United States Patent [19]

Perrella

[11] 4,013,116

[45] Mar. 22, 1977

[54] DIE-CASTING MACHINE

[76] Inventor: Guido Perrella, 205 Edgehill Road, Westmount, Quebec, Canada

[22] Filed: Nov. 10, 1975

[21] Appl. No.: 630,388

Related U.S. Application Data

[63] Continuation of Ser. No. 406,073, Oct. 12, 1973, abandoned.

[52] U.S. Cl. ..... 164/262; 164/303; 164/343

[51] Int. Cl.[2] ..... B22D 11/126; B22D 17/26

[58] Field of Search ..... 164/303, 342, 343, 119, 164/324, 262; 92/66

[56] References Cited

UNITED STATES PATENTS

| | | | |
|---|---|---|---|
| 295,159 | 3/1884 | Fitts et al. | 92/66 X |
| 2,521,520 | 9/1950 | Jancura | 164/342 X |
| 2,790,217 | 4/1957 | Tyler | 164/343 X |
| 3,118,196 | 1/1964 | Hall et al. | 164/262 |

*Primary Examiner*—Leon Gilden
*Attorney, Agent, or Firm*—Beveridge, DeGrandi, Kline & Lunsford

[57] ABSTRACT

A die casting machine is described and includes a frame supporting two pairs of spaced, parallel cylinder assemblies with each pair of assemblies carrying a mold half and being opposed to the other pair of assemblies which carry the other mold half. Each cylinder assembly of each pair comprises a stationary piston secured to the frame; a piston shaft secured to and co-axial with the piston, the shaft extending across to a connection with an opposed piston of the other pair; and a cylinder is mounted on the piston and shaft for reciprocal movement thereon in response to fluid injected therein on either side of the piston. Means connect the cylinder to their respective mold halves whereby injection of fluid into the cylinders at the crown ends of the pistons forces the two pairs of cylinders and two mold halves together and fluid injection at the skirt ends of the pistons forces the cylinders and mold halves apart. The terminal forces from opening the two pairs of cylinders are taken by the two parallel piston shafts.

6 Claims, 5 Drawing Figures

DIE-CASTING MACHINE

This is a continuation of application Ser. No. 406,073 filed Oct. 12, 1973 now abandoned.

This invention relates to a die-casting machine. More particularly, the invention relates to a die-casting machine having a pair of oppositely disposed cross-heads that are movable reciprocally to open and close a mold along a parting plane.

BACKGROUND OF THE INVENTION

Die-casting machines of the prior art are many in design and mode of operation. It is well known to use such machines for making castings of a heat-softenable material such as zinc, a zinc alloy, or the like. One of the problems associated with prior art die-casting machines has been the necessity of making those machines bulkier and more massive to withstand increased forces holding the dies locked during casting. This has been necessary to a large extent because the frame members of prior art die-casting machines were designed to absorb the loads derived from forces holding the dies locked. More specifically, the toggle-mechanism commonly used in previous die-casting machines was actuated by a piston and cylinder combination. These pistons and cylinders exerted a force which was amplified through the toggle mechanism and that amplified force had to be absorbed by frame members of the die-casting machine.

SUMMARY OF THE INVENTION

The present invention simplifies and overcomes a number of problems associated with die-casting machines of the prior art. Significant advantages are derived from Applicant's invention. Thus, we provide a die-casting machine having a pair of movable cross-heads that define four opposed cylinders which are movable in relation to the pistons housed in those cylinders. Prior art machines normally have movable pistons associated with opening and closing of the mold in which the castings are made. In a die-casting machine according to Applicant's invention, however, the pistons are held fixed, being supported by a main frame of the machine. The cylinders, or more accurately the cross-heads in which the cylinders are formed, are instead designed to be movable. Each piston divides or separates an enclosing cylinder into two sections. Ports are provided in the cross-heads to conduct a substantially incompressible fluid, preferably a conventional hydraulic fluid, in and out of the sections of each cylinder. A fluid circuit is also provided, being operable selectively to direct fluid, under pressure, into one of the chambers or sections of each cylinder. The cross-heads are thereby caused to reciprocate, moving in opposite directions to effect opening and closing of the mold. The embodiments described herein are designed having cross-heads configured for convenience to support complementary parts of the mold. The cross-heads are also used in a preferred embodiment of Applicant's invention to support a release mechanism operable periodically to release a casting from the mold.

Various features and objects are achieved with this invention. These will become apparent from the following detailed description, especially when read in conjunction with the accompanying drawings. These drawings illustrate by way of example only, a number of preferred embodiments of the invention.

DESCRIPTION OF THE PREFERRED EMBODIMENTS

Figure 1:
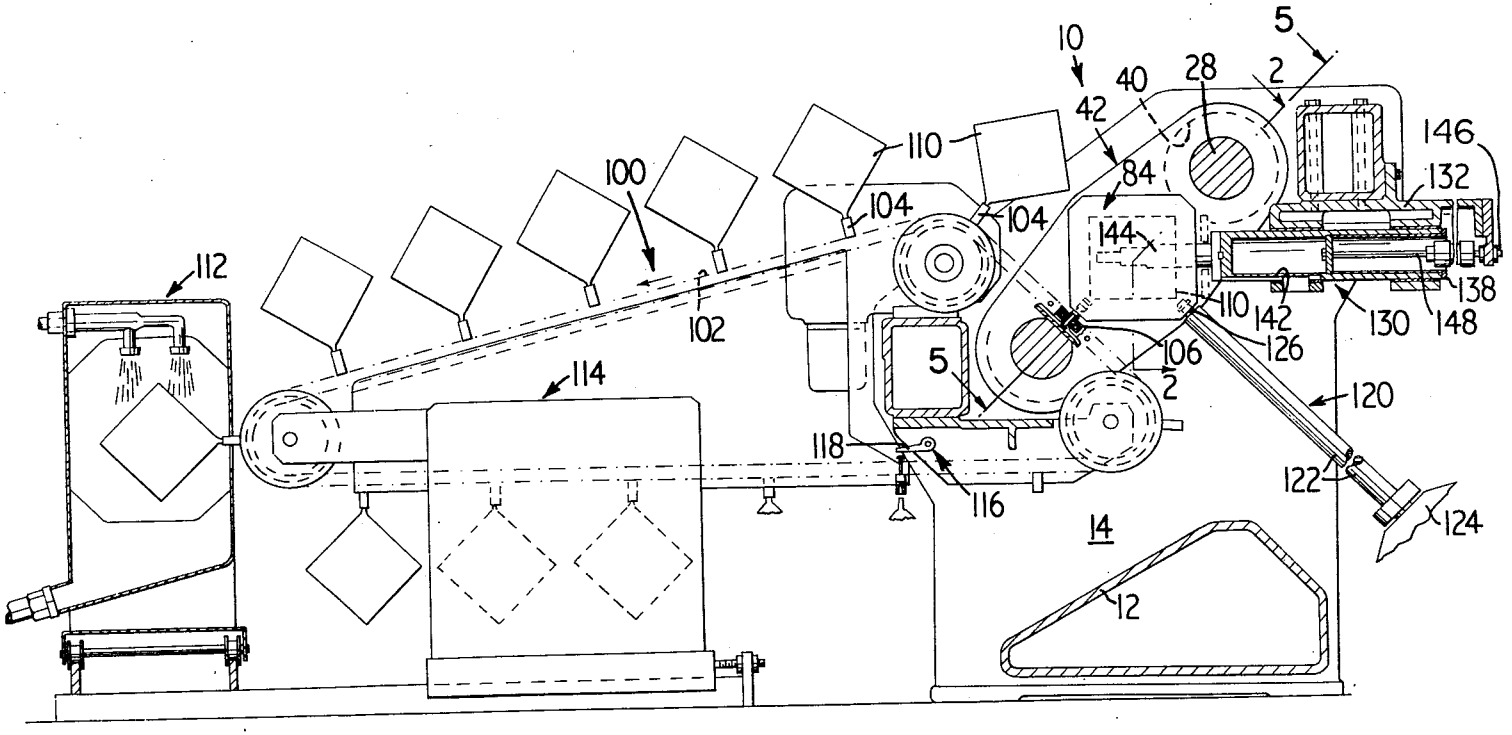
FIG. 1 is an end elevation view taken partly in section to show some details of the die-casting machine of FIG. 1.

In the drawings the same reference numeral is identifies the same part in each Figure illustrating the same embodiment encompassed by the invention. Thus, one preferred form of this invention is embodied in a die-casting machine shown overall at 10 in FIGS. 1–3 and 5. The machine 10 is made up of a base casting 12 and a pair of upstanding frame members 14. The base 12 and frame members 14 are conveniently made as a casting of steel or other such suitable metal. Moreover, the base casting 12 and frame elements 14 are designed to be secured together rigidly, for instance, by steel bolts 16. Welding or some other suitable fastening technique can be used as an alternative method for joining these parts together.

Figure 2:
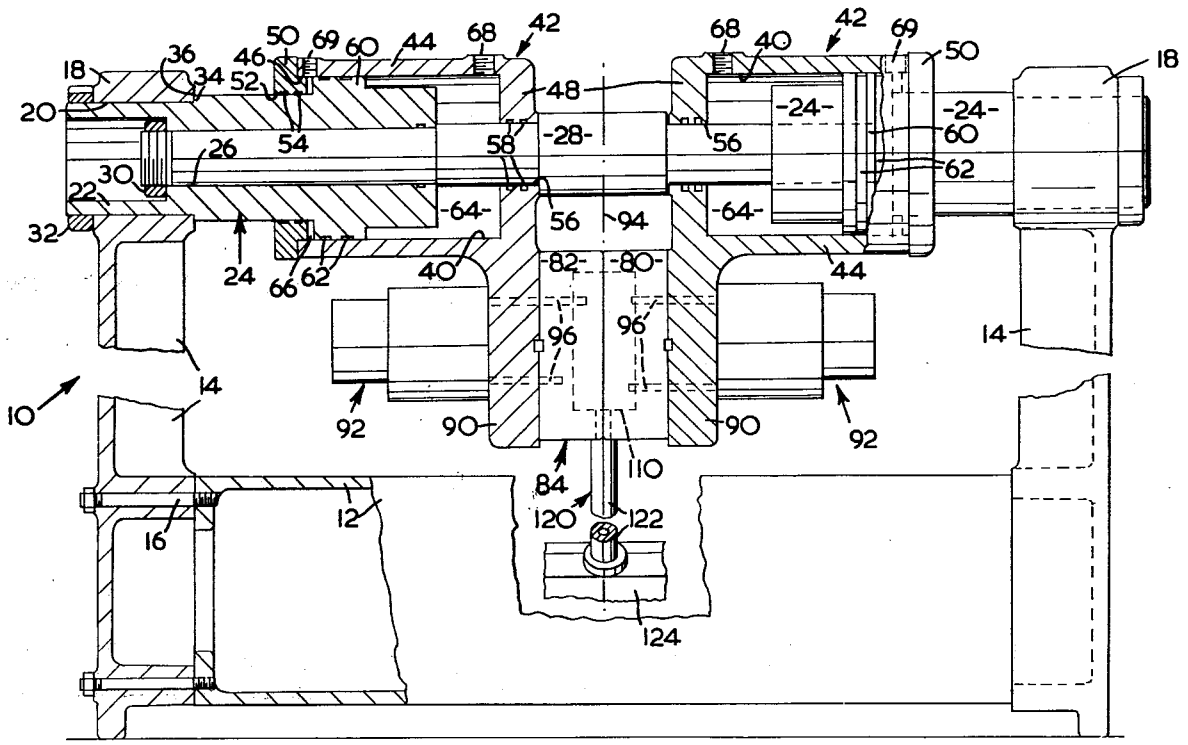
FIG. 2 is a front elevation view taken partly in section along line 2—2 of FIG. 1.
Figure 3:
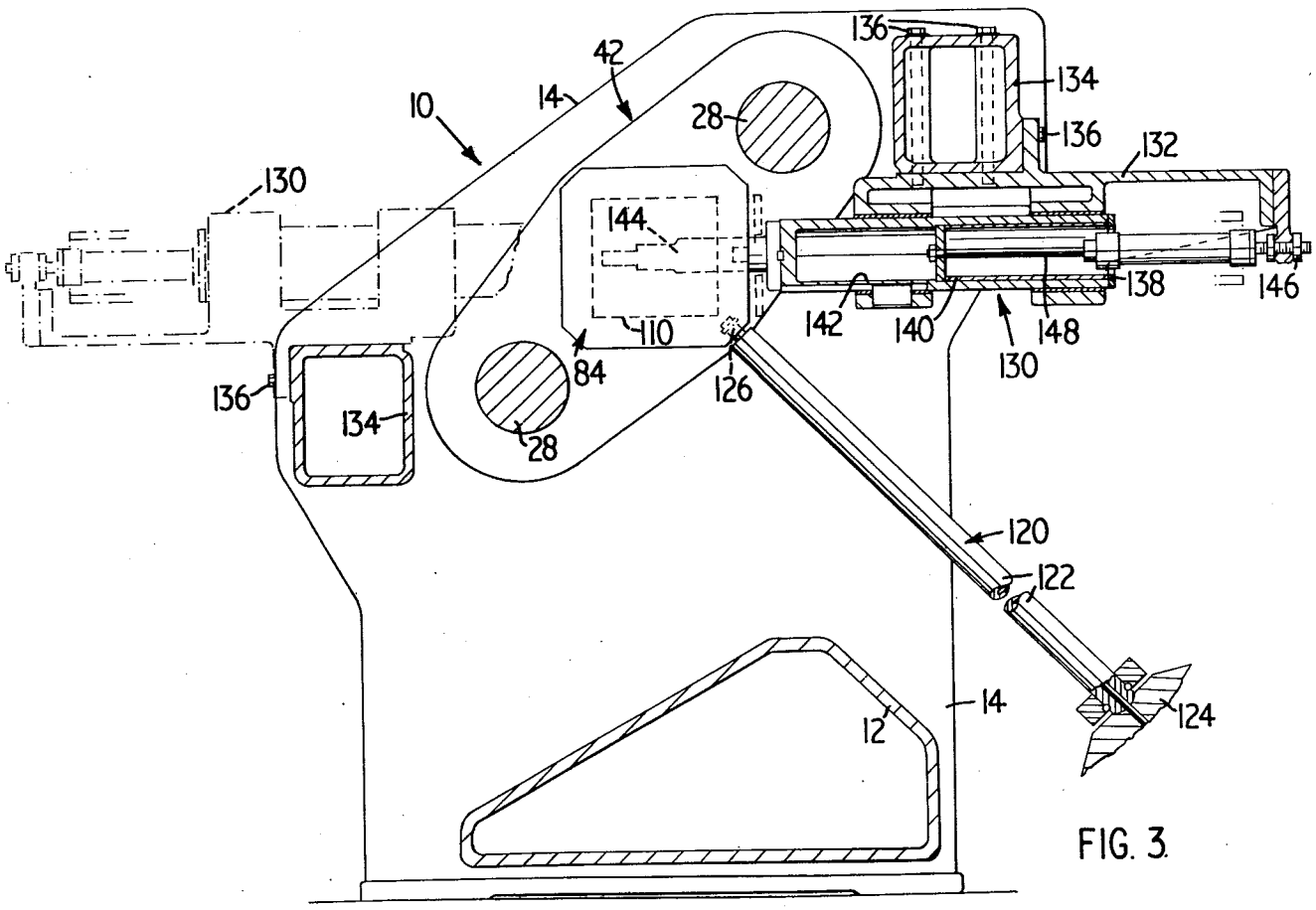
FIG. 3 is an end elevation view taken partly in section to show details of another embodiment encompassed by the present invention.
Figure 5:
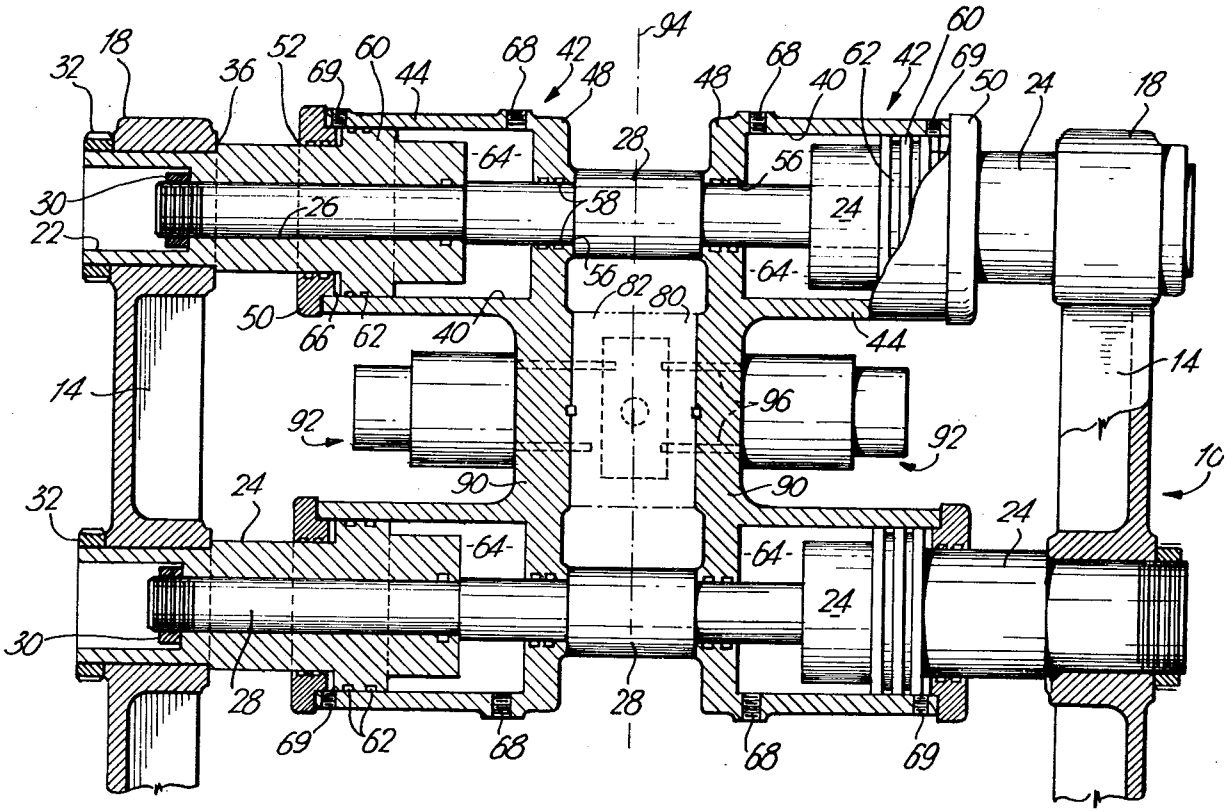
FIG. 5 is a cross sectional view taken along the line 5—5 of FIG. 1.

As best seen in FIGS. 2 and 5, each of the side frame members 14 is formed with a pair of trunions 18 which define openings 20 normally having a circular cross-section. Each opening 20 in each of the frame members 14 is adapted closely to receive a spigotted end 22 of a piston 24. The spigotted end 22 defines a recess which connects with a central passageway 26. This passageway 26 extends longitudinally and coaxially of the piston 24. The central passageway 26 is adapted to house a piston shaft 28 that functions to couple the two pistons 24 of each pair thereof together. The shafts 28 are threaded at opposite ends thereof to receive a similarly threaded nut 30 which can be tightened as required to secure the two pairs of pistons 24 rigidly together. It might also be noted here that each spigotted end 22 of the pistons 24 is formed with exterior threads to receive an internally threaded nut 32. Each piston has a cross-section which is slightly greater in size centrally than the spigotted end 22. An outwardly facing shoulder 34 is thereby formed, to provide a stop against which the inwardly facing surface 36 of each trunion 18 will abut. Tightening the nut 32 will clamp the piston 24 securely in place with trunion surfaces 36 abutting firmly against the stop 34 on each piston.

In accordance with a particular feature of this invention, each of the pistons 24 is adapted to be received in a cylinder 40 which is formed in each of a pair of oppositely disposed and reciprocally movable cross-heads 42, there being four cylinders 40, two on each cross head symmetrically opposed to two on the other cross head. Each cylinder 40 has walls 44 which define an open end 46 and a substantially closed end 48. The open end 46 is adapted to be closed and sealed by a cover plate 50 which has a central opening 52 that is provided with ring-like sealing means 54. Sealing means 54 engage the outer surface of the central section of each piston 24 in a manner which seals the cylinder 40, but allows for movement of the cross-head 42 relative to the fixed pistons 24. Being secured to the frame members 14, the pistons 24 are stationary.

The substantially closed end 48 of each cylinder 40 is also provided with a central opening 56. These openings are also provided with ring-like sealing means 52 similar to the sealing means 54. Sealing means 58 are in sealed engagement with a central portion of each shaft 28 which interconnects the associated two pistons 24. At a location spaced from about ½ to ¾ of the distance from the spigotted end 22, each piston 24 is provided with a radially outwardly extending rib or shoulder 60. Each rib 60 is provided with sealing rings 62 that are in sealable engagement with the interior surface of the cylinder walls 44. Each cylinder 40 is thereby separated or divided into two sections or chambers shown at 64 and 66. The cylinder walls 44 are provided with ports 68 and 69 that are adapted to conduct a substantially incompressible fluid, respectively, to the sections or chambers 64 and 66. The incompressible fluid is preferably a conventional hydraulic fluid, say, a solution of water and ethylene glycol, or the like.

It is convenient to emphasize at this point, that FIGS. 2 and 5 show the die-casting machine 10 in a condition in which complementary parts of a multi-part die are being held locked together. For simplicity, complementary sections 80 and 82 of a two part die or mold 84 are illustrated schematically in the accompanying drawings. The mold 84 will be of a shape and design required to cast an item of any particular configuration.

It is seen from FIGS. 2 and 5 that introduction of an incompressible fluid, under pressure, into the chamber 64 (through port 68) will cause a closing force to be generated. That closing force is the product of the surface area of the closed end 48 of the cylinder 40 multiplied by the pressure under which the fluid in chamber 64 is being kept. At those times when the fluid in the chamber 64 is pressurized, i.e., held under pressure as by a pump or the like, any fluid in the other chamber 66 normally will not be under any pressure. As an example, it is expected that the internal diameter of the cylinders 40 can be approximately 14 inches, while the diameter of the portion of shaft 28 within the chamber 64 will be about 5 inches. Accordingly, the surface over which the pressurized fluid in chamber 64 can act, in this particular example, will be an annular band or zone that is some 4.5 inches in width. Depending upon the pressure under which the fluid in the chamber 64 is to be placed, a locking force of up to 200 tons can be developed to hold the die 84 locked. Such a locking force is derived from the fluid which is intended to be subjected to a pump pressure of up to about 1500 psi.

Since the force required to unlock and open the die 84 is substantially smaller, the surface area of the cylinder 40 on which the pressurized fluid in the chamber 66 will act, is also smaller. That is in comparison to the surface area of end wall 48 in chamber 64. Thus, the active area of the inner surface of the face plate 50, over which the fluid will act, will also be an annular band that can be approximately 1 to 1.5 inches in width.

It will be recognized that a conventional fluid circuit (not shown) is provided to enable the incompressible fluid to be introduced selectively, under pressure, into the chambers 64 and 66, as required to open or close the die 84. FIGS. 2 and 5 show that movement of the cross-heads 42 in response to the introduction of a pressurized fluid into one of the chambers 64 or 66, will cause movement of those cross-heads in opposite directions. Complete details of the fluid circuit and its manner of operation are not included at this time. Such a description will be well-known to practioners in this art. Furthermore, a description of an electrical control circuit which can provide automatic operation of the fluid circuit and thus opening and closing of the mold 84 in a predetermined timed sequence has also been omitted since it too will be well known to those skilled in this art.

Figure 4:
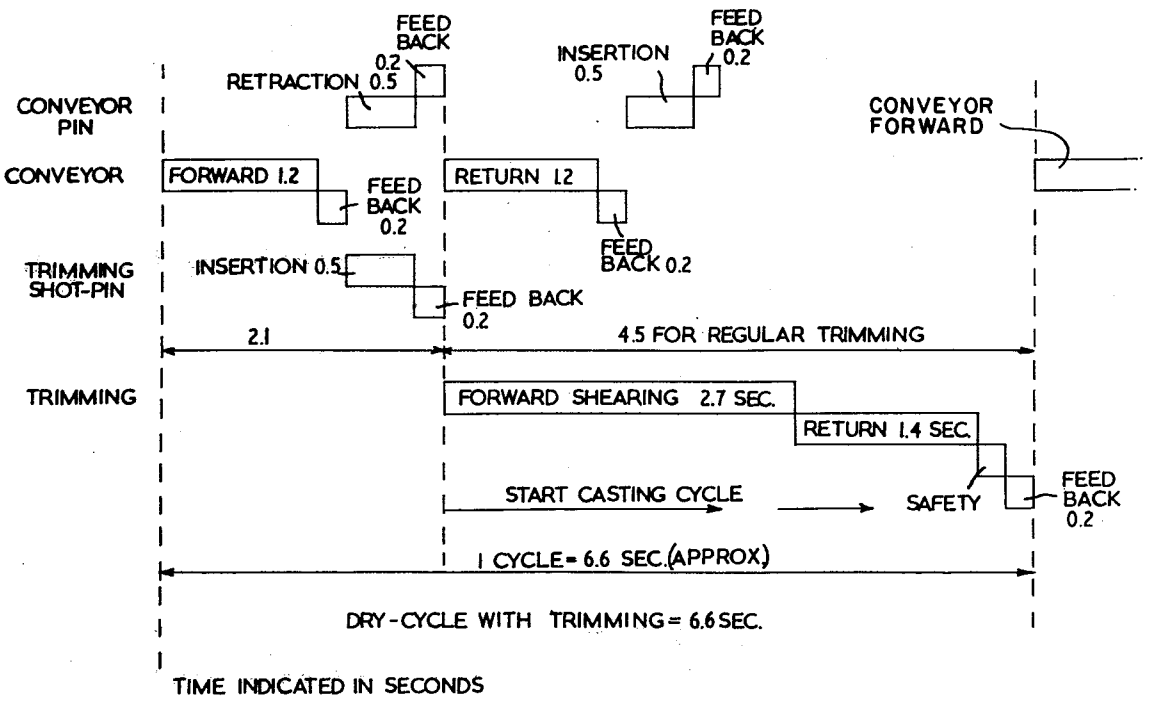
FIG. 4 is a diagram showing the sequence of operations contemplated in using the invention embodied in the machine of FIG. 1.

FIG. 4, however, does set out the sequence of operation of the die-casting machine 10, as envisaged herein.

Returning to FIGS. 2 and 5, it is seen that each of the movable cross-heads 42 is provided with a base or support flange 90 on which the complementary sections of the mold 84 are carried. With reference to FIG. 5 particularly, the sections 80 and 82 can be mounted on the support flanges 90 by fastening means that are well-known in this art. These can include threaded fasteners, pin means or the like.

Each of the support flanges or bases 90 is also adapted to carry a release mechanism 92, which is operable to release a casting from the mold when the two sections of the latter are moved apart. The complementary sections of the multi-part mold 84 come together along a parting plane indicated at 94. The release mechanism 92 includes hydraulically actuatable pins shown at 96, operable in a well-known manner to apply a slight amount of pressure to the casting upon separation of the sections 80 and 82 of the mold 84. The casting is therefore released from the mold 84.

In accordance with another feature of this invention, a transfer mechanism 100 is provided as an accessory. See FIG. 1. The transfer mechanism 100 is disposed generally adjacent the die-casting machine 10, and includes a conveyor arrangement 102 which is adapted to traverse a path lying generally in the same plane as parting plane 94 (of FIG. 2). The conveyor 102 includes holding means shown generally at 104 and these are positionable in a predetermined location shown at 106 in FIG. 1. The holding means 104 includes a tube-like base which is adapted, at the location 106, to be placed in flow-communication with the casting being made. Accordingly, when a charge of flowable material is injected into the die 84, a small amount of that material flows into the holding means 104. This material forms a sprue by which the casting can be held while it is transferred away from the die-casting machine 10.

In FIG. 1, the transfer mechanism 100 is illustrated as carrying a casting 100 initially to a quenching unit 112 and subsequently to a trimming unit 114. The trimming unit may have one or two stations at which trimming takes place. The trimming operation is carried out in a manner generally similar to that known in this art. A difference which does exist involves both halves of a trimming die moving to close around the parting plane 94 of the casting 110 being trimmed at that location.

In FIG. 1 a sprue discharge mechanism 116 is mounted on the die-casting machine 10. This sprue discharge mechanism includes a tappet or arm 118 which is actuated periodically, to depress a plunger making part of the holding means 104. As the plunger is depressed, it pushes the sprue out of the holding means 104.

A further feature of Applicant's invention can be seen from FIG. 2. There, unlike most prior art die-casting machines, an injection nozzle 120 is positioned with its axis coincident with the parting plane 94 of the mold 84. This injection nozzle 120 comprises a heated barrel 122 which conducts the heat-softened and flowable zinc or other casting material from a melting pot 124 to the mold 84. The nozzle barrel 122 is provided with a discharge funnel 126 (FIG. 1&3) that is adapted to be received with sealed engagement in a mating recess provided in the mold 84. That mating recess has one part thereof provided in the mold section 80 and another part in the other mold section 82. Further yet, the mating faces of the mold sections 80 and 82 are each provided with complementally formed channels or recesses which define a runner for conducting the casting material into the body of the mold 84. Unlike the practice in prior art die-casting machines 10 the melting pot 124 is disposed some distance from the die-casting machine 10. In this way there is less heat radiated to the die-casting machine 10. The melting pot 124 and injection nozzle 120 are adapted to inject heat softened flowable casting material at an injection pressure, for example, of up to about 2,000 psi into the mold 84.

The mold or die 84 and sections 80 and 82 thereof are generally conventional in structure, being designed to provide a casting of a predetermined shape. Applicant's die-casting machine 10, however, does include a core holder assembly 130 which is carried right on the die-casting machine 10. This is unlike the prior art practice which generally had the core holder assembly provided separate from the die-casting machine. In any event, the core holder assembly 130 is provided with a supporting base 132 which is fixedly secured to a tubular box member 134 that is carried by the upstanding frame members 14. There are normally two box members 134 provided in order to accommodate either one, or two (FIG. 3) core holder assemblies 130 depending upon the complexity of the core being required in connection with any particular mold 84. It is well known that in some instances a single piece core can be used, while in other instances the core is made up of two or more sections. In any event, each core holder assembly 130 is fastened by bolts, screws or other such fasteners shown at 136 to the box member 134.

A hydraulic actuator 138 comprises a piston and cylinder combination 140 and 142. That piston and cylinder combination 140 and 142 are adapted to be hydraulically actuated in a manner which moves a core element 144 reciprocally along a stroke which may, in this instance, be up to 6 inches long. A suitable adjustment nut 146 is provided at the outwardly facing end of a piston shaft 148 for purposes of varying the stroke and distance through which the core element 144 is to be moved.

It will be evident to those persons knowledgeable in this art that operation of the hydraulic actuator 138 is controlled through the operation of the electrical control circuit and the fluid circuit. Such persons could select any one of a variety of specific circuits to govern functioning of the die-casting machine 10 in accordance with the sequence of operations in FIG. 4. In the embodiment illustrated herein, a dry cycle rate of operation of the die-casting machine 10 can be programmed for up to 1200 pieces per hour, i.e., one piece every 3 seconds, or as shown in FIG. 4, a dry cycle rate with trimming of about 540 pieces per hour.

It will be evident from the foregoing description that a number of significant advantages are derived from this invention. A die-casting machine embodied by Applicant's invention is provided with a pair of movable cross-heads incorporating four cylinders mounted on four pistons and which each develop a force closing and holding the mold carried thereby in a locked condition, while also providing a reactionary force equal in magnitude equal to the former. In this way, heavy closing forces required to hold mating sections of die locked, are not transferred in their entirety to the frame members of the die-casting machine. A more compact and lighter machine can therefore be constructed without sacrificing the die locking forces. It is also convenient to utilize die blocks which are carried directly on the movable cross-heads, along with a release mechanism that releases a casting upon opening of the die. Further yet, it will be apparent that certain advantages can be derived by having the melting pot for the material from which a casting is to be made, spaced some distance from the die-casting machine itself. It is well known that die casting machines frequently have considerable amount of inflammable material such as oil around them. The high temperatures required to maintain the material in a flowable condition could readily ignite some of these inflammables. Further yet, the very substantial amounts of heat radiated by the melting pot can also be removed from the immediate vicinity of the die-casting machine. This would be of benefit to an operator, as well as avoiding any problems which could arise due to thermal stresses being imposed on any parts of the die-casting machine.

The foregoing description has described some preferred embodiments encompassed by Applicant's invention. Some modifications have been suggested and others will be apparent to those knowledgeable in this art. It is comprehended within the spirit of this invention to encompass all such improvements and changes as would be obvious to those skilled in this art and falling within the scope of the claims below.

I claim:

1. A die-casting machine comprising a frame; a pair of spaced, parallel piston shafts mounted in said frame; a first pair of spaced, parallel cylinder assemblies mounted on one end of said pair of piston shafts; said first pair of assemblies supporting a mold half which is disposed therebetween, a second pair of spaced parallel cylinder assemblies mounted on the other ends of said pair of piston shafts and supporting a second mold half which is disposed therebetween, said parallel cylinder assemblies of said first pair being symetrically opposed to the parallel cylinder assemblies of said second pair; each of said cylinder assemblies of the two pairs thereof comprising (a) a stationary piston secured to one of the piston shafts on the frame and being coaxial therewith (b) said shaft extending across to a connection with an opposed piston of the other pair; and (c) a cylinder mounted on the piston and shaft for reciprocal movement thereon in response to incompressible fluid injected therein on either side of said piston; whereby injection of fluid into the cylinders at the crown ends of the pistons forces the cylinders and mold halves together and injection of the fluid at the skirt ends of the pistons forces the cylinders and mold halves apart; the terminal force from opening the cylinders being taken by the piston shafts; said piston shafts being spaced by a distance which permits a casting formed by the mold to be removed from the mold along a path which is perpendicular to the shafts.

2. The machine defined in claim 1, wherein each cylinder assembly includes flange means for supporting at least one of the mold halves, said flange means also being operative to support a release mechanism actuatable periodically to release a casting from the mold.

3. A die casting machine having a multipart mold separable along a parting plane and adapted to receive a charge of material from which a casting is made, including a main frame and means for releasing the casting from the mold, a pair of opposed first and second piston means secured to and supported from the main frame in spaced apart relation; first shaft means extending between and interconnecting said first and second piston means; and an associated pair of first and second cylinders, a pair of opposed third and fourth piston means secured to and supported from the main frame in spaced apart relation; second shaft means extending between and interconnecting said third and fourth piston means; and an associated pair of third and fourth cylinders, each said cylinder being sealable and configured to surround its respective one of the pistons; each of the pistons serving to define two sections within each cylinder, with each said section being provided with port means adapted to conduct a liquid in and out of that section; a pair of oppositely disposed cross-heads, each of which includes two of said cylinders, means for connecting a mold half to each of said cross-heads medially between the cylinders thereof, said cross-heads being slidable on and supported by said piston means and movable relative thereto in opposite directions in response to selective introduction of said liquid, under pressure, into one of the sections of each cylinder, thereby to effect opening and closing of said mold; said first shaft and said second shaft being spaced apart by a distance which permits a casting formed by the mold to be removed from the mold along a path which is perpendicular to said shafts, each of said cross-heads being parallel to the other cross-head and each being disposed in alignment and movable axially of the piston means.

4. The die-casting machine defined in claim 3, including support means on each cross-head to carry pin means for releasing the casting from the mold.

5. The die-casting machine defined in claim 3, wherein there is also provided a transfer mechanism for removing castings released from said mold, said transfer mechanism being disposed to transfer the castings along a path lying in a plane generally coincident with said parting plane.

6. The die-casting machine defined in claim 3, wherein a core assembly is provided supported by the main frame, and including means for holding the core, and actuating means operable to advance and retract said core, said actuating means being responsive in a timed sequence simultaneously to closing and opening of the mold.

* * * * *